US005675043A

United States Patent [19]

Eppig et al.

[11] Patent Number: 5,675,043

[45] Date of Patent: Oct. 7, 1997

[54] PROCESS FOR THE SELECTIVE REMOVAL OF NITROGEN-CONTAINING COMPOUNDS FROM HYDROCARBON BLENDS

[76] Inventors: Christopher P. Eppig, 2713 Lancashire #2, Cleveland Heights, Ohio 44106; E. T. Robinson, 6701 Silvermound, Mentor, Ohio 44060; Paul Greenough, 17 Woodland Drive, Beaconsfield, Bucks HP9 1JY, England

[21] Appl. No.: 579,086

[22] Filed: Nov. 21, 1995

Related U.S. Application Data

[63] Continuation of Ser. No. 209,810, Mar. 11, 1994, abandoned.

[51] Int. Cl.[6] ..... C07C 41/34

[52] U.S. Cl. ..... 568/697; 568/833

[58] Field of Search ..... 568/697, 833

[56] References Cited

U.S. PATENT DOCUMENTS 2,741,578 4/1956 McKinnis et al. .

2,902,428 9/1959 Kimberlin et al. .

4,605,489 8/1986 Madgavkar .

5,210,326 5/1993 Marquez et al. ..... 568/697

*Primary Examiner*—Johann Richter

*Assistant Examiner*—John Peabody

*Attorney, Agent, or Firm*—David J. Untener; Michael F. Esposito; Brian L. Mehosky

[57] ABSTRACT

A process for the removal of nitrogen-containing compounds from a hydrocarbon blend using a solvent with a liquid-phase density at 25° C. not less than 0.90 g/cm$^3$, and a Hansen polar solubility parameter $\delta_P$, and a Hansen hydrogen bonding parameter $\delta_H$, such that at 25° C.

$$9.0(Cal/cm^3)^{1/2}<(\delta_P+\delta_H)<28.0(Cal/cm^3)^{1/2}.$$

The process is useful for purifying feedstocks to catalytic conversion processes, particularly etherification processes used in the production of ether-rich additives for gasoline.

17 Claims, 1 Drawing Sheet

PROCESS FOR THE SELECTIVE REMOVAL OF NITROGEN-CONTAINING COMPOUNDS FROM HYDROCARBON BLENDS

This is a continuation of application Ser. No. 08/209,810 filed Mar. 11, 1994 now abandoned.

BACKGROUND OF THE INVENTION

1. Field of the Invention

The present invention relates to the use of one or more solvents in a process for the removal of nitrogen-containing compounds from hydrocarbon blends. The hydrocarbon blends may be utilized as feeds to any catalytic conversion process employing nitrogen-sensitive catalysts. Of particular interest is utilizing the hydrocarbon blends in the $C_3$ to $C_7$ range as feedstocks in the production of ether-rich additives for gasoline, and, more particularly, the production of methyl-tertiary-butyl ether (MTBE), ethyl-tertiary butyl ether (ETBE), tertiary-amyl ethyl ether (TAEE), tertiary-amyl methyl ether (TAME) or mixtures thereof from hydrocarbon blends. Hydrocarbon blends with reduced levels of nitrogen-containing compounds are particularly suitable as precursors to gasoline compatible ethers, as well as other petroleum and chemical processes. The product MTBE, TAME, ETBE, TAEE, and mixtures thereof are desirable, high value-added gasoline blending stocks.

Government legislation stipulating minimum oxygenate content of gasolines has spurred large scale increases in production capacity for gasoline-compatible ethers including, for example, MTBE, ETBE, TAEE and TAME. These materials are used extensively as fuel extenders and octane value improving agents in the production of unleaded gasoline. Frequently, except for the inclusion of such fuel extenders and octane value improving agents, acceptable octane values can only be obtained by varying the compounding additives in the gasoline.

Additionally, motor fuels containing oxygenates burn cleaner in internal combustion engines. The higher oxygen content of such fuel reduces the formation of carbon monoxide, and lower amounts of unburned hydrocarbons are present in the engine exhaust gases. The employment of oxygenated blending additives in gasoline blends leads to a cleaner burning motor fuel, thereby improving air quality and the overall environmental condition.

Ethers, such as MTBE, ETBE, TAME and TAEE, are potential oxygenated blending additives. Ethers are typically produced by catalytic processing of light hydrocarbons. Nitrogen-containing compounds in the hydrocarbon feedstock to ether production units have a deleterious effect on etherification catalysts. Nitrogen-containing compounds may quickly deactivate the catalyst and reduce the yield of desired ether products.

2. Related Art

There are many processes developed in the prior art for producing MTBE, ETBE, TAEE, TAME, and other ethers. These ethers are manufactured by reaction of the appropriate olefins and alcohols over acidic ion exchange resins which function as catalysts for the etherification reactions.

Typical etherification processes are disclosed in U.S. Pat. Nos. 5,001,292; 4,925,455; 4,827,045; and 4,830,635 to Harandi et al. Other known processes include that disclosed in U.S. Pat. No. 4,025,989 to Hagan et al. For the most part, these known processes for preparing ethers as additives for gasoline comprise reacting a primary alcohol, such as methanol, with an olefin having a double bond on a tertiary carbon atom, such as isobutylene and isopentenes. It is known in the prior art to react the alcohol and the olefin in the presence of a catalyst. Suitable known catalysts include Lewis acids (sulfuric acid) and organic acids (alkyl and aryl sulfonic acids), typically in the form of ion exchange resins.

U.S. Pat. No. 5,210,326 to Marquez et al describes adsorption of nitrogen compounds and mercaptan and water on a superactivated alumina medium from hydrocarbon streams used as etherification feedstock. U.S. Pat. No. 2,013,663 to Malisoff describes the use of polyhydric alcohols and their derivatives as useful for sulfur removal from hydrocarbon oils, while the use of sulfur dioxide for extraction of cyclic sulfur and nitrogen compounds is described by Nelson in *Petroleum Refinery Engineering,* Fourth Edition, p. 352, New York, McGraw-Hill, 1958. Robbins, in "Liquid-Liquid Extraction: A Pretreatment Process for Industrial Wastewater," presented at the AIChE Meeting, Philadelphia June 1980, provides a solute-solvent interaction table claimed to aid in the selection of solvents with favorable distribution coefficients for solutes. Table 1 of that paper teaches that alcohols and ethers would not be effective solvents for nitrile solutes. Azeotropic distillation of water from triethylene glycol with isooctane is described in detail in "'Super-Drizo' The Dow Dehydration Process", by A. Fowler, Proceedings of the 25th Annual Gas Conditioning Conference, University of Oklahoma, Mar 3–5 1975, and is incorporated herein by reference. U.S. Pat. No. 5,238,541 to Marquez et al describes removal of nitriles from etherification feedstocks by admixing the hydrocarbon with methanol, ethanol or propanol and azeotropically distilling a substantially nitrile-free product.

U.S. Pat. No. 2,212,105 to Yabroff describes the use of an aqueous solution of caustic alkali and a solubility promoter, such as triethylene glycol, to eliminate small quantities of organic, relatively weak acid reacting compounds from liquid hydrocarbons. U.S. Pat. No. 2,848,375 to Gatsis describes the removal of basic nitrogen impurities from hydrocarbons using boric acid and a polyhydroxy organic compound. U.S. Pat. No. 2,295,612 to Soday, U.S. Pat. No. 2,411,025 to Coughlin, U.S. Pat. Nos. 2,727,848 and 2,886,610 to Georgian, U.S. Pat. No. 2,770,663 to Grote, and U.S. Pat. No. 4,469,491 to Finkel describe using one or more polyhydric alcohols in the solvent extraction of hydrocarbon mixtures, but none disclose the removal of nitrogen-containing compounds from catalytic reactor feedstocks. U.S. Pat. No. 4,498,980 to Forte describes using polyalkylene glycols to separate aromatic and non-aromatic hydrocarbons.

Removal of nitrogen-containing compounds from hydrocarbon blends used as feedstocks in catalytic conversion processes can significantly enhance unit operability, process economics and product properties. The presence of nitrogen-containing compounds can lead to catalyst deactivation, reduced product yields, and shorter unit cycle times, i.e., the time period between necessary catalyst regeneration or replacement. Catalytic conversion processes that can be detrimentally affected by nitrogen-containing compounds in hydrocarbon feedstocks include, but are not limited to, olefin alkylation, HF and $H_2SO_4$ alkylation, naphtha cracking to ethylene, steam reforming to produce carbon monoxide and hydrogen, hydrocarbon reduction, such as butadiene to butane, and catalytic polymerization. Examples of typical nitrogen specifications for such processes would be a 5 ppm wt/wt maximum total nitrogen in HF alkylation feedstocks to avoid excessive acid consumption, and 0.2 ppm wt/wt total nitrogen in catalytic polymerization feedstocks to minimize neutralization of the acid sites on the phosphoric acid/kieselguhr catalyst. Acidic ion exchange resins used as catalysts in etherification reactors are also susceptible to poisoning by nitrogen-containing compounds in the hydrocarbon feed.

While many hydrocarbon blends may be used as feedstocks for etherification to MTBE, ETBE, and TAME, it is particularly useful in petroleum refining operations to process MTBE, ETBE and TAME from hydrocarbon streams resulting from fluid catalytic cracking (FCC) refinery operations. Frequently referred to as cracked naphthas, these hydrocarbon blends are typically in the $C_3$–$C_7$ range. Hydrocarbons in the $C_4$–$C_5$ range containing some isoalkenes are most desirable as etherification feedstocks.

When processing hydrocarbon blends under etherification conditions to form, for example, MTBE and TAME it has been found that the presence of nitriles in the feedstock leads to catalyst poisoning. That is, the catalysts used in the process are rapidly deactivated. Our studies of the phenomenon concluded that the nitriles themselves are not, in fact, the catalysts poisons. Even though the nitriles are not in themselves acidic ion exchange resin catalyst poisons, they are converted to basic nitrogen compounds which are catalyst poisons. As the catalyst materials used in known processes are relatively expensive, and spent etherification catalysts are currently classified as hazardous waste in the United States, the foregoing problem of catalyst deactivation leads to not only process inefficiency but also to substantial increases in processing costs.

Naturally, it would be highly desirable to provide a process for the removal of substantially all of the nitriles present in such hydrocarbon blends, particularly hydrocarbon blends from refinery processes used for MTBE, ETBE and TAME production.

SUMMARY OF THE INVENTION

Accordingly, it is a primary object of the present invention to provide a process for the removal of nitrogen-containing compounds from a hydrocarbon blend. Another object of the present invention is to provide a process to reduce nitrogen-containing compounds in hydrocarbon feedstocks for catalytic conversion processes. Yet another object of the present invention is to provide a process to reduce nitrogen-containing compounds in hydrocarbon feedstocks to catalytic etherification production units utilized to produce ether-rich additives.

To achieve the foregoing objects, and in accordance with the purpose of the invention as broadly described herein, the process for treating a hydrocarbon blend containing nitrogen-containing compounds to effect removal of a portion of the nitrogen-containing compounds therefrom of this invention comprises:

(a) providing a hydrocarbon blend containing nitrogen-containing compounds;

(b) contacting the hydrocarbon blend with a solvent, the solvent characterized by (i) a liquid-phase density at 25° C. not less than 0.90 g/cm$^3$, and (ii) a Hansen polar solubility parameter $\delta_P$, and a Hansen hydrogen bonding parameter $\delta_H$, such that at 25° C.

$$9.0(Cal/cm^3)^{1/2}<(\delta_P+\delta_H)<28.0(Cal/cm^3)^{1/2}$$

to remove at least a portion of the nitrogen-containing compounds to form a purified hydrocarbon mixture; and (c) separating the purified hydrocarbon blend from the solvent and the nitrogen-containing compounds.

The process of this invention further comprises utilizing the purified hydrocarbon of (c), separated from the solvent and the nitrogen-containing compounds, as a feedstock to a catalytic conversion process, such as catalytic cracking of naphtha to ethylene, catalytic steam reforming, catalytic hydrocarbon oxidation, catalytic reduction of dienes to olefins, and catalytic alkylation, and in particular, catalytic etherification utilized to produce ether-rich additives.

Still further, the process for treating a hydrocarbon blend containing nitrogen-containing compounds to effect removal of a portion of the nitrogen-containing compounds therefrom of this invention comprises:

(a) providing a hydrocarbon blend containing nitrogen-containing compounds;

(b) contacting the hydrocarbon blend with a solvent selected from the group comprising sulfolane, a polyalkylene glycol, and mixtures of the same; and (c) separating the purified hydrocarbon blend from the solvent and the nitrogen-containing compounds.

In one of its aspects, this invention comprises selecting the polyalkylene glycol in (b from the group consisting of triethylene glycol, tetraethylene glycol, and mixtures of the same.

More specifically, the inventions comprises contacting the hydrocarbon blend containing nitrogen-containing compounds with the solvent utilizing liquid/liquid extraction, including the use of packed columns, trayed columns, York-Schiebel columns, Karr columns, mixer settlers, electrostatic systems, centrifugal extractors, and the like.

The present invention also comprises a process for the conversion of hydrocarbon blends to ether-rich additives such as MTBE, ETBE, TAEE and TAME in an efficient and economic manner.

Additionally, the present invention comprises a process as aforesaid wherein the poisoning of the catalysts used in the etherification process is inhibited.

Moreover, the present invention comprises a process as aforesaid wherein the hydrocarbon blend fed to the etherification zone is contacted with a polyalkylene glycol, sulfolane, or a combination of the same, for the removal of nitriles prior to etherification.

More specifically, the present invention comprises a process as aforesaid wherein the hydrocarbon blend fed to the etherification zone is contacted with a polyalkylene glycol selected from the group consisting of triethylene glycol, tetraethylene glycol, and mixtures of the same, for the removal of nitriles, particularly acetonitrile, propionitrile, and mixtures of acetonitrile and propionitrile, prior to etherification.

Further, the present invention comprises a process as aforesaid wherein the hydrocarbon blend fed to the etherification zone is contacted with sulfolane for the removal of nitriles, particularly acetonitrile, propionitrile, and mixtures of acetonitrile and propionitrile, prior to etherification.

Also, the present invention comprises a process as aforesaid wherein the solvent used in the process of the present invention is recovered, purified and returned for further use in the process.

Further objects and advantages of the present invention will appear hereinbelow.

DETAILED DESCRIPTION OF THE INVENTION

Figure 1:
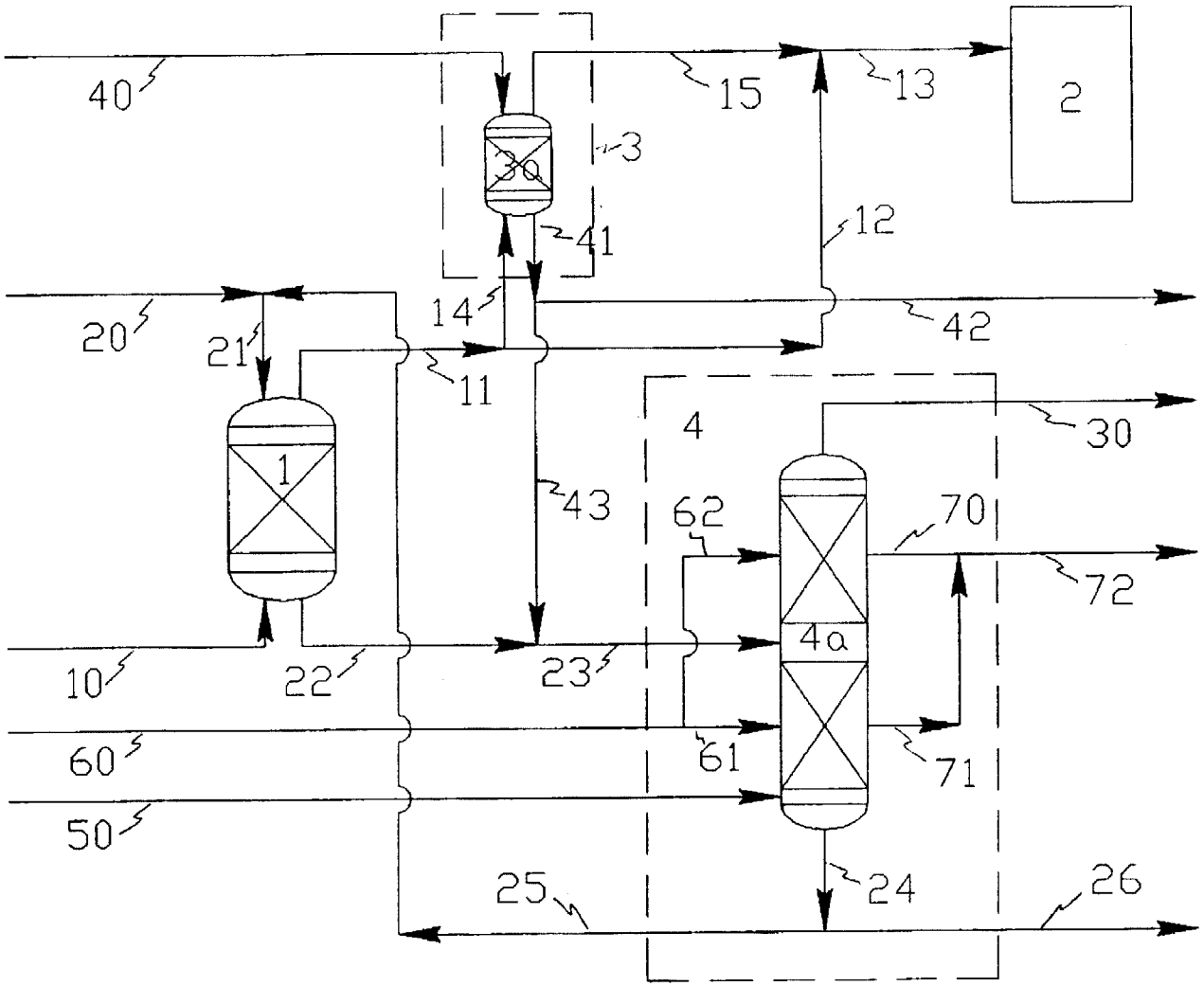
FIG. 1 is a schematic flow diagram of an illustrative embodiment of the invention.

Solvents, and solvent blends, with a liquid-phase density at 25° C. not less than 0.90 g/cm$^3$, and a Hansen polar solubility parameter $\delta_P$, and a Hansen hydrogen bonding parameter $\delta_H$, such that at 25° C.

$$9.0(Cal/cm^3)^{1/2}<(\delta_P+\delta_H)<28.0(Cal/cm^3)^{1/2} \quad (Equation\ 1)$$

have been found to be effective in selectively removing nitrogen-containing compounds from hydrocarbon blends. Particularly effective are solvents, and solvent blends, which satisfy the above criteria with a Hansen hydrogen bonding parameter $\delta_H$ less than about 15 at 25° C. Hansen solubility parameter data are available in the literature, e.g. in Hansen, C., and A. Beerbower, *Kirk-Othmer Encyclopedia of Chemical Technology, 2nd Ed., Supplemental Volume*, Interscience, 1971, pp 889–910, incorporated herein by reference. Solubility parameters for solvent blends are calculated as molar volume weighted-mean values.

Of interest is the removal of nitrogen-containing compounds from hydrocarbon blends used as feedstocks catalytic reactors. Of particular interest is the removal of nitriles from hydrocarbon blends used as feedstocks etherification reactors. With more particularity, the present invention may be used to remove acetonitrile and propionitrile from hydrocarbon blends used as feedstocks for producing MTBE, ETBE, TAEE and TAME.

In accordance with the present invention, nitriles and other nitrogen compounds are removed from hydrocarbon blends to produce a purified catalytic reactor feedstock: which is substantially free of nitrogen compounds, particularly nitriles. Nitriles, produced in refinery processes, are found in etherification reactor unit feed streams, such as MTBE, ETBE, TAEE and TAME unit feed streams, despite the fact that they have higher boiling points than the hydrocarbons in the respective feeds. This is due to the formation of nitrile azeotropes in the material, inhibiting nitrile removal by standard refinery practices. Acetonitrile is the predominant nitrile found in MTBE and ETBE unit feed streams, and propionitrile is the predominant nitrile in TAME and TAEE unit feed streams.

FIG. 1 is a simplified process flow diagram illustrating one example of the use of a solvent for the continuous selective removal of nitrogen-containing compounds from a hydrocarbon feedstock, specifically, using a solvent for the removal of nitriles from an etherification reactor feedstock. In accordance with the present invention, the hydrocarbon blend from the refinery facility is fed to the extractor vessel 1 via line 10. Also fed to the extractor vessel 1, via lines 20 and 21, is a solvent with a liquid-phase density at 25° C. not less than 0.90 g/cm$^3$ and solubility parameters that satisfy Equation 1.

The hydrocarbon feedstock, as described previously, is a hydrocarbon blend, typically a $C_3$–$C_7$ cut, preferably substantially a $C_4$–$C_5$ cut, most preferably substantially a $C_4$–$C_5$ cut containing some isoalkene. The hydrocarbon feedstock may be a composite blend from more than one refinery or chemical process, or the product stream of fluid bed catalytic cracking, a selective desulfurization process, a process for the selective hydrogenation of diolefins, and the like.

In particular, the solvents useful in this invention include sulfolane, a polyalkylene glycol, and mixtures of the same. The polyalkylene glycols useful as solvents are glycols of the formula:

$$RO—[CH_2—(CH_2)_n—O]_m—H$$

where R=hydrogen or methyl, n=1 or 2, and $m \geqq 1$;

preferably, $1 \leqq m \leqq 4$. More preferably, the polyakylene glycol is selected from the group consisting of triethylene glycol, tetraethylene glycol, and mixtures of the same.

The solvent may be a substantially pure compound, contain a mixture of two or more substantially pure compounds, or contain one or more compound diluted with one or more co-solvents, as long as the pure material, mixture or diluted material satisfies the solubility and density parameters specified.

As used herein, nitrogen-containing compounds include all nitrogen-containing materials at least partially soluble or miscible with, organic solvents. Specifically, nitrogen-containing compounds encompass nitriles described by the formula $$R—C{\equiv}N$$

wherein R is $C_1$ to $C_6$ alkyls. More specifically, nitrogen-containing compounds encompass acetonitrile, propionitrile, and mixtures of acetonitrile and propionitrile.

The function of the extractor vessel 1 is to maintain the hydrocarbon feed and the solvent in intimate contact for a period of time sufficient to allow for the interphase mass-transfer of nitrogen-containing compounds from the hydrocarbon to the solvent. Extraction units are conventional and well known in the art, and may include packed columns, trayed columns, York-Schiebel columns, Karr columns, mixer settlers, electrostatic systems, centrifugal extractors, and the like. Depending upon the solvent selected, the extraction unit may operate with co-current or counter-current flow of feed and solvent. Counter-current operation is depicted in FIG. 1, with the hydrocarbon feed entering the extractor vessel at the bottom, and the solvent entering the vessel at the top. Due to their disparate densities, the hydrocarbon rises through the extractor vessel, while the solvent descends the vessel, the two intimately contacted thereby.

Higher operating temperatures of the extractor vessel reduces hydrocarbon blend and solvent viscosities and affords greater rates of mass transfer, which is desirable. However, higher temperatures also generally decrease solvent selectivity and increase the unit operating pressure, which are generally less desirable. Optimum extractor vessel operating temperature can be determined by one skilled in the art, but the operating temperature is usually between 60° and 300° F. Operating pressure will obviously depend upon the vapor pressure of the hydrocarbon feed, the solvent selected, and the operating temperature selected, and usually ranges between 5 and 1000 psia.

After the hydrocarbon feed and solvent have remained in intimate contact for a period of time sufficient for the interphase mass-transfer of nitrogen-containing compounds from the hydrocarbon to the solvent, the hydrocarbon raffinate is withdrawn from the extractor vessel 1 via line 11. The raffinate may be fed directly, via lines 11, 12 and 13, to a catalytic conversion process, such as an etherification reactor facility 2 or, optionally, further processed to remove any residual solvent in the stream. Typically, only a small amount of solvent is present in the stream, and it may be removed by several methods known in the art, such as utilizing a raffinate purification unit 3.

One method of raffinate purification, depicted in FIG. 1, is to wash the raffinate with a wash solvent. A typical wash solvent is water. The wash solvent may also be diluted with a co-solvent. The raffinate is directed from the extraction vessel 1 to the wash vessel 3a via lines 11 and 14. A wash solvent, and wash co-solvent if used, is also fed to the wash vessel via line 40. In a manner similar to that described for the operation of the extractor vessel 1, the raffinate and wash solvents are intimately contacted to remove any residual solvent from the raffinate. The purified etherification feedstock is then withdrawn from the wash vessel 3a and directed to the etherification reactor facility via line 15 and 13. The spent wash solvent, including a wash co-solvent if used, containing the residual solvent from the extraction process, a minor portion of the hydrocarbon blend and other impurities, may be disposed of or transferred to another process via lines 41 and 42 or, optionally, combined via lines 41 and 43 with the extract withdrawn via line 22 from the extractor vessel 1. The extractor vessel extract and, optionally, spent wash solvent, is fed to the solvent recovery system 4 via line 23.

Efficient recovery of the solvent contained in the extract stream 22 is vital for an effective and economic process. The recovery should optimize the extent of removal of nitrogen containing compounds from the solvent; optimize the extent of removal of accumulated diluents and co-solvents from the solvent; optimize the extent of removal of entrained/extracted hydrocarbons from the solvent; and optimize the extent of removal of other trace impurities from the solvent. Simultaneously, the solvent recovery system should minimize thermal degradation of the solvent; minimize hydrolysis of extracted nitrogen containing compounds; minimize reaction of nitrogen containing compounds and other trace impurities with the solvent; and minimize polymerization of reactive hydrocarbons.

Differing methods of solvent recovery can have differing levels of effectiveness in meeting the goals described above. Such methods include thermal distillation, vacuum distillation, steam stripping, gas stripping, azeotropic distillation, liquid/liquid re-extraction, solid adsorption, solid absorption, selective chemical reaction, a combination of these processes, and the like.

In FIG. 1 the solvent recovery system 4 is depicted as a thermal distillation column 4a with optional gas or steam stripping via line 50, and also the option of co-feeding a material to permit azeotropic distillation, via line 60, and lines 61 or 62, but could be one or more of the methods described above.

As depicted, extract from the extractor vessel 1 is directed via lines 22 and 23 to the distillation column 4a. Optionally, the spent wash solvent, and spent wash co-solvent if used, from the raffinate purification unit 3 can be combined with the extractor vessel extract using line 43, and the combined material directed to the solvent recovery system 4 via line 23. Nitrogen containing compounds, raffinate purification solvents, optional raffinate purification co-solvents, wash solvents, optional wash co-solvents and other impurities are removed from the distillation tower overhead via line 30, or optionally removed as one or more sidedraw streams via lines 70, 71 and 72. These streams may be directed to disposal, product recovery, Or otherwise utilized.

Recovered solvent is withdrawn from the distillation tower sump or reboiler via line 24, and returned for reuse in the extractor vessel 1 via line 25 and 21. The recovered solvent may be further cooled to an appropriate extraction temperature using a supplemental heat exchanger, if necessary, before being returned to the extractor vessel 1. Optionally, all or a portion of the recovered solvent may be withdrawn from the process via line 26. Typically, a small portion of recovered solvent is withdrawn from the process via line 26 or from one or more sidedraws (70 and 71) to remove trace impurities that would otherwise concentrate in the system and lead to process instabilities. An amount of fresh solvent equal to the amount withdrawn, plus the amount of solvent that degrades in use or is otherwise lost from the system, is added via line 20.

In accordance with the preferred embodiment of the present invention, the purified etherification feedstock which is fed via line 13 to the etherification reactor has a total nitrogen content of less than about 10 ppm wt./wt. more preferably less than about 5 ppm wt/wt, most preferably less than about 1 ppm wt/wt. The etherification reactor feed has a total nitrile content of less than about 40 ppm wt/wt, more preferably less than about 15 ppm wt/wt, most preferably less than about 4 ppm wt/wt. When producing MTBE, etherification reactor feed has a total acetonitrile content of less than about 30 ppm wt/wt, more preferably less than about 15 ppm wt/wt, most preferably less than about 4 ppm wt/wt. When producing TAME, etherification reactor feed has a total propionitrile content of less than about 40 ppm wt/wt, more preferably less than about 20 ppm wt/wt, most preferably less than about 5 ppm wt/wt.

Alternately, the present invention may be used to proportionally reduce nitrogen-containing compounds in hydrocarbon mixtures. Typically, for hydrocarbon blend feedstocks containing nitrogen-containing compounds, the present invention may be used to reduce the concentration of nitrogen-containing compounds to levels less than about 15% of the feedstock; preferably to levels less than about 10%, more preferably to levels less than about 5%, most preferably to levels less than about 2% of the feedstock.

It has been found, in accordance with the process of the present invention, that by reducing the nitrogen compounds (particularly nitriles) the life of the catalyst used in the etherification reactor is greatly improved. A decrease of nitriles in the etherification reactor feed from about 10 mg/l to about 1 mg/l significantly increases unit cycle life. Operating economics for etherification reactors are thus appreciably enhanced by decreased nitrile content in hydrocarbon feedstocks to MTBE, ETBE, TAEE and TAME units, and significant economic benefits can thus be realized by the removal of these nitrogen containing compounds.

The purified etherification reactor feed is delivered via line 13 to the etherification reactor wherein the feedstock is processed under typical etherification conditions in the presence of a catalyst so as to produce ether-rich additives, particularly, MTBE, ETBE, TAME and TAEE. The catalyst employed in the etherification reactor is typically in the form an acidic ion exchange resin. Etherification reactors typically operate at a pressure in the range of 75–500 psia, and a temperature in the range of 85°–250° F. Depending on the nature of the feedstock to the etherification reactor, either MTBE, ETBE, TAME, TAEE, or a mixture of the ethers may be produced. For example, if the feed to the etherification reactor is substantially rich in $C_4$ iso-olefins, the product produced is MTBE or ETBE. If the feedstock is a hydrocarbon blend rich in $C_5$ iso-olefins the resulting ether-rich additive is TAME or TREE. If the hydrocarbon feedstock is a mixture of hydrocarbons containing $C_4$–$C_7$ iso-olefins, the product of the etherification reactor is a mixture of $C_4$–$C_7$ methyl or ethyl ethers.

As can be seen from the foregoing, the process of the present invention allows for the pretreatment of the feedstock to catalytic conversion processes, such as an etherification reactor system, in a continuous uninterrupted manner. The advantages and superior results obtained by the process of the present invention will be made clear hereinbelow from a consideration of the following illustrative examples.

EXAMPLES 1a–1h

Batch one-stage solvent extraction tests using various solvents were conducted with a synthetic hydrocarbon blend to determine raffinate yields and propionitrile distribution coefficients. The solvent to hydrocarbon volume ratio used in the tests was 1:2.5. All tested solvents had a liquid-phase density at 25° C. not less than 0.90 g/cm$^3$ and Hansen solubility parameters that satisfied Equation 1. Results for the solvents tested are listed ill Table 1, as well as a comparative test using water, for which $(\delta_P+\delta_H)=28.5$.

A synthetic $C_5$ blend was prepared and analyzed by gas chromatography to contain:

| | |
|---|---|
| 3-methyl-butene-1 | 14.14 (wt%) |
| isopentane | 40.45 |
| 1-pentene | 2.36 |
| 2-methyl-butene-1 | 0.32 |
| isoprene | 3.01 |
| 2-methyl-butene-2 | 39.65 |
| other $C_4$–$C_6$s | 0.07 |

The blend was then spiked with high-purity propionitrile to give a blend nitrogen content of 113 ppm wt/wt as measured by a calibrated Antek chemiluminescent nitrogen measurement system.

The raffinates produced were water washed. The washed raffinates were analyzed for nitrogen content and by gas chromatography to quantify their hydrocarbon composition. Nitrogen content and distribution coefficients, DC, for the unwashed raffinates were back-calculated based upon a mass balance.

TABLE 1

| Test No. COMP-ARATIVE EX-AMPLE | Solvent | Feed Blend Nitrogen (ppm wt/wt) | Raffinate Nitrogen (ppm wt/wt) | Fractional Raffinate Yield | DC |
|---|---|---|---|---|---|
| | Water | 113 | 58.0 | 0.999 | 1.50 |
| 1a | Diethylene glycol | 113 | 34.6 | 0.999 | 3.23 |
| 1b | Dipropylene glycol | 113 | 34.6 | 0.999 | 3.53 |
| 1c | Triethylene glycol | 113 | 32.1 | 0.999 | 3.57 |
| 1d | Triethylene glycol monomethyl ether | 113 | 29.7 | 0.978 | 4.07 |
| 1e | Tetraethylene glycol | 113 | 30.9 | 0.998 | 3.76 |
| 1f | Triethylene glycol +2.5 wt % $H_2O$ @ 25° C. | 113 | 35.8 | 0.999 | 3.06 |
| 1g | Triethylene glycol +2.5 wt % $H_2O$ @ 45° C. | 113 | 38.3 | 0.999 | 2.82 |
| 1h | Sulfolane @ 45° C. | 113 | 22.2 | 0.991 | 5.14 |

Sulfolane had the highest distribution coefficient for propionitrile removal. The glycols also exhibited good distribution coefficients. However, the triethylene glycol monomethyl ether extracted about 8% of the isoprene, resulting in a lower raffinate yield. Addition of water to triethylene glycol reduced the nitrile extraction distribution coefficient.

Furfural, monoethanol amine and blends of triethylene glycol with 15 wt % ethylene carbonate also selectively extracted propionitrile from the $C_5$ feed.

EXAMPLE 2

The extraction procedures of Example 1c was repeated, except that pure isopentane, spiked with high purity propionitrile to a level of 84 ppm wt/wt nitrogen, was substituted for the spiked synthetic $C_5$ mixture. This test was conducted to compare extraction from a single component hydrocarbon stream containing a nitrogen-containing compound with extraction from a more typical hydrocarbon blend. Triethylene glycol was used as the solvent, and the distribution coefficient was measured to be 4.5.

This higher distribution coefficient for pure isopentane relative to the blend in Example 1c illustrates the effect that feed olefins have on reducing the distribution coefficient for nitrile extraction. This also indicates that for a given solvent, the exact distribution coefficient for any given hydrocarbon feed will be dependent upon the feed composition, optimum solvents cannot be easily determined a priori, and that solvent selection must be based upon careful laboratory testing.

EXAMPLE 3

5 wt % distilled water was added to a sample of the extract of Example 1c, and the resulting blend boiled at atmospheric pressure. The temperature of the boiling water/extract blend increased as water boiled off. After the blend temperature reached 350° F., the sample was cooled to ambient temperature. The nitrogen content of the boiled extract was measured, and found to have been reduced from approximately 110 ppm wt/wt of nitrogen to less than 5 ppm wt/wt, indicating that the propionitrile had been stripped from the extract along with the water.

The present invention may be embodied in other forms or carried out in other ways without departing from the spirit or essential characteristics thereof. The present embodiments are therefore to be considered as in all respects illustrative and not restrictive, the scope of the invention being indicated by the appended claims, and all changes which come within the meaning and range of equivalency are intended to be embraced therein.

We claim:

1. A process for treating a hydrocarbon blend containing nitrogen-containing compounds to effect removal of a portion of said nitrogen-containing compounds therefrom, comprising:

(a) providing a hydrocarbon blend containing nitrogen-containing compounds; and (b) contacting said hydrocarbon blend with a solvent, said solvent characterized by (i) a liquid-phase density at 25° C. not less than 0.90 g/cm$^3$, and (ii) a Hansen polar solubility parameter $\delta_P$, and a Hansen hydrogen bonding parameter $\delta_H$, such that at 25° C.

$$9.0(Cal/cm^3)^{1/2}<(\delta_P+\delta_H)<28.0(Cal/cm^3)^{1/2}$$

to extract at least a portion of said nitrogen-containing compounds from said hydrocarbon blend to said solvent.

2. The process of claim 1 wherein said solvent selected from the group consisting of sulfolane, a polyalkylene glycol, and mixtures of the same.

3. The process according to claim 1 wherein said solvent has the formula:

$$RO—[CH_2—(CH_2)_n—O]_m—H$$

where R is selected from the group consisting of hydrogen and methyl, n is an integer selected from the Group consisting of 1 and 2, and m is not less than 1.

4. The process according to claim 3, wherein m is not less than 1 and not greater than 4.

5. The process according to claim 1 wherein said solvent is selected from the group consisting of triethylene glycol, tetraethylene glycol, and mixtures of the same.

6. The process according to claim 2 wherein said nitrogen-containing compounds are nitriles.

7. The process according to claim 6 wherein said nitriles are selected from the group consisting of acetonitrile, propionitrile, and mixtures of the same.

8. The process of claim 1 wherein said solvent is selected from the group consisting of sulfolane, a polyalkylene glycol, and mixtures of the same.

9. The process according to claim 1 wherein said solvent has the formula:

$$RO-[CH_2-(CH_2)_n-O]_m-H$$

where R is selected from the group consisting of hydrogen and methyl, n is an integer selected from the group consisting of 1 and 2, and m is not less than 1.

10. The process according to claim 9 wherein m is not less than 1 and not greater than 4.

11. The process according to claim 1 wherein said solvent is selected from the group consisting of triethylene glycol, tetraethylene glycol, and mixtures of the same.

12. The process according to claim 8 wherein said nitrogen-containing compounds are nitriles.

13. The process according to claim 12 wherein said nitriles are selected from the group consisting of acetonitrile, propionitrile, and mixtures of the same.

14. The process according to claim 1 wherein said solvent is recovered for re-use.

15. The process of claim 14 wherein said solvent is recovered using a method selected from the group consisting of thermal distillation, vacuum distillation, steam stripping, gas stripping, azeotropic distillation, liquid/liquid re-extraction, solid adsorption, solid absorption, selective chemical reaction, and a combination of these processes.

16. The process of claim 15 wherein said solvent is recovered using thermal distillation.

17. The process of claim 1 wherein said hydrocarbon blend is the product stream of process selected from the group consisting of fluid bed catalytic cracking, selective desulfurization, and selective hydrogenation of diolefins.

* * * * *